US007432880B2

(12) United States Patent
Tachibana et al.

(10) Patent No.: US 7,432,880 B2
(45) Date of Patent: Oct. 7, 2008

(54) METHOD OF DRIVING PLASMA DISPLAY PANEL

(75) Inventors: Hiroyuki Tachibana, Osaka (JP); Naoki Kosugi, Kyoto (JP); Toshikazu Wakabayashi, Osaka (JP); Shigeyuki Okumura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/573,935

(22) PCT Filed: Sep. 14, 2005

(86) PCT No.: PCT/JP2005/016938

§ 371 (c)(1),
(2), (4) Date: Mar. 23, 2007

(87) PCT Pub. No.: WO2006/030825

PCT Pub. Date: Mar. 23, 2006

(65) Prior Publication Data

US 2007/0222706 A1 Sep. 27, 2007

(30) Foreign Application Priority Data

Sep. 15, 2004 (JP) ..... 2004-267958

(51) Int. Cl.
*G09G 3/28* (2006.01)

(52) U.S. Cl. ..... 345/60; 345/66; 345/67

(58) Field of Classification Search ..... 345/60–69, 345/204–215

See application file for complete search history.

(56) References Cited

U.S. PATENT DOCUMENTS

2006/0256040 A1* 11/2006 Chae ..... 345/63

FOREIGN PATENT DOCUMENTS

| | | |
|---|---|---|
| JP | 08-096714 A | 4/1996 |
| JP | 09-245627 | 9/1997 |
| JP | 09-245627 A | 9/1997 |

(Continued)

OTHER PUBLICATIONS

International Search Report for Appl. No. PCT/JP2005/016938 dated Dec. 20, 2005.
English translation of Form PCT/ISA/210.

*Primary Examiner*—Vijay Shankar
(74) *Attorney, Agent, or Firm*—RatnerPrestia

(57) ABSTRACT

A method of driving a plasma display panel having display electrode pairs each one of which pairs is formed of a scan electrode and a sustain electrode. A priming electrode is placed in every other spaces between the display electrode pairs and in parallel with the display electrode pairs. An addressing period includes an odd-line addressing period in which an address operation is conducted to primary discharge cells having odd-number scan electrodes, an even-line addressing period in which an address operation is conducted to primary discharge cells having even-number scan electrodes. During the respective addressing periods, scan pulse voltage Va is applied to odd-number scan electrodes or even-number scan electrodes while priming pulse voltage Vp is applied, prior to the application of the scan pulse voltage, to a priming electrode adjacent to the scan electrode to which scan pulse voltage Va is to be applied, in order to generate a priming discharge between the priming electrodes and the data electrodes.

3 Claims, 6 Drawing Sheets

FOREIGN PATENT DOCUMENTS

| | | | |
|---|---|---|---|
| JP | 10-063222 | | 3/1998 |
| JP | 11-297211 | | 10/1999 |
| JP | 11-297211 | A | 10/1999 |
| JP | 11-345570 | | 12/1999 |
| JP | 11-345570 | A | 12/1999 |
| JP | 2001-185034 | A | 7/2001 |
| JP | 2002-150949 | | 5/2002 |
| JP | 2002-150949 | A | 5/2002 |
| JP | 2003-151445 | | 5/2003 |
| JP | 2004-287174 | A | 10/2004 |

* cited by examiner

METHOD OF DRIVING PLASMA DISPLAY PANEL

This application is a U.S. National phase application of PCT international application PCT/JP2005/016938.

TECHNICAL FIELD

The present invention relates to a method of driving plasma display panels to be used in wall-mounted television receivers or large-size monitors.

BACKGROUND ART

A plasma display panel (hereinafter simply referred to as "panel") is a display device excellent in visibility and features a large size, thin and light weight screen.

An AC surface discharge panel, one of typical panels, comprises numbers of discharging cells formed between a front plate and a back plate confronting each other. The front plate comprises display electrode pairs each one of which pair is formed of a scan electrode and a sustain electrode, and the display electrode pairs are formed in parallel to each other on a front glass substrate. A dielectric layer and a protective layer are formed such that those two layers cover the display electrodes. The back plate comprises a plurality of data electrodes formed on a back glass substrate in parallel to each other, a dielectric layer covering the plurality of data electrodes, and a plurality of barrier ribs formed on the dielectric layer in parallel with the data electrodes. The dielectric layer has a phosphor layer on its surface, and the barrier ribs have phosphor layers on their lateral faces. The front plate confronts the back plate such that the display electrode pairs and the data electrodes form two-level crossings. The front plate and the back plate are sealed, and discharge gas is filled in a discharge space of the sealed body. In the foregoing panel, gas-discharge in respective discharge cells will generate ultraviolet rays, which then excite and emit the phosphors of respective colors, i.e. Red, Green and Blue, thereby displaying a gray scale.

The sub-field method is generally used as a method of driving the panel, this method divides one field period into a plurality of sub-fields, and combines some sub-fields emitting respectively for displaying a gradation. Each one of the sub-fields has an initializing period, an addressing period, and a sustaining period.

In the initializing period, every discharge cell carries out the initializing discharge all at once, so that hysteresis of wall electric charges with respect to each one of discharge cells is cancelled, and yet, wall electric charges necessary for an address operation coming next are formed. On top of that, the initializing period works to generate "priming" (exciting particles=initiating agent for discharge). In the addressing period, scan pulse voltages are sequentially applied to the scan electrodes, and address pulse voltages corresponding to video signals to be displayed are applied to the data electrodes, so that address-discharges are selectively generated between the scan electrodes and the data electrodes for forming selective wall electric charges. In the sustaining period following the addressing period, sustain pulse voltages are applied the given number of times between the scan electrodes and the sustain electrodes, so that the discharge cells, which have formed wall electric charges due to address discharge, selectively discharge and emit.

As discussed above, it is important to conduct the address discharges selectively in the addressing period in order to display a video correctly. However, there are several factors delaying the discharges, e.g. a high voltage cannot be used to an address pulse voltage due to constraints of the circuit structure, or the phosphor layer formed on the data electrodes make it difficult to conduct the address discharges. Thus the priming for steadily generating the address discharges becomes a crucial factor.

The priming generated by the discharges, however, decreases rapidly with the passage of time, so that the priming generated by the initial discharge becomes in short supply for the address discharge to be conducted long after the initial discharge. As a result, the discharge delays longer, which makes the address operation unstable and lowers the video quality, or an address time is set longer in order to make the address operation stable, so that the address operation resultantly takes too much time.

Unexamined Japanese Patent Publication No. H09-245627 discloses a panel and a method of driving the panel: a priming electrode is provided for generating the priming so that a discharge delay becomes shorter. This panel, however, tends to invite interference between discharge cells adjacent to each other. Particularly in the addressing period, the discharge of the discharge cells adjacent to each other produces some priming which sometimes causes an address error or an address defective. A margin in a driving voltage for the address operation becomes thus smaller.

DISCLOSURE OF INVENTION

A panel driving method of the present invention drives the plasma display panel that comprises the following elements:

- a plurality of display electrode pairs, each one of which electrode is formed of a scan electrode and a sustain electrode placed on a first substrate;
- a plurality of priming electrodes placed in parallel with and between the display electrode pairs and yet in every other display electrode pairs; and
- a plurality of data electrodes placed on a second substrate, confronting the first substrate with a discharge space in between, such that they are placed along a direction crossing the display electrode pairs. The display electrode pairs confront the data electrodes, thereby forming primary discharge cells, and the priming electrodes confront the data electrodes, thereby forming priming discharge cells. One field is formed of plurality of sub-fields each one of which includes an initializing period, an addressing period, and a sustaining period. The addressing period includes an odd-line addressing period, in which primary discharge cells having odd-number scanning electrodes are addressed, and an even-line addressing period, in which primary discharge cells having even-number scanning electrodes are addressed. In the odd-line addressing period, scanning pulses are sequentially applied to the odd number scanning electrodes while a priming pulse voltage is applied, prior to the application of the scanning pulse voltage, to the priming electrode adjacent to the scanning electrode to which the scanning pulse voltage is to be applied, in order to generate a priming discharge between the priming electrode and the data electrode. In the even-line addressing period, scanning pulses are sequentially applied to the even-number scanning electrodes while a priming pulse voltage is applied, prior to the application of the scanning pulse voltage, to the priming electrode adjacent to the scanning electrode to which the scanning pulse voltage is to be applied, in order to generate a priming discharge between the priming electrode and the data electrode.

DESCRIPTION OF REFERENCE MARKS

Figure 1:
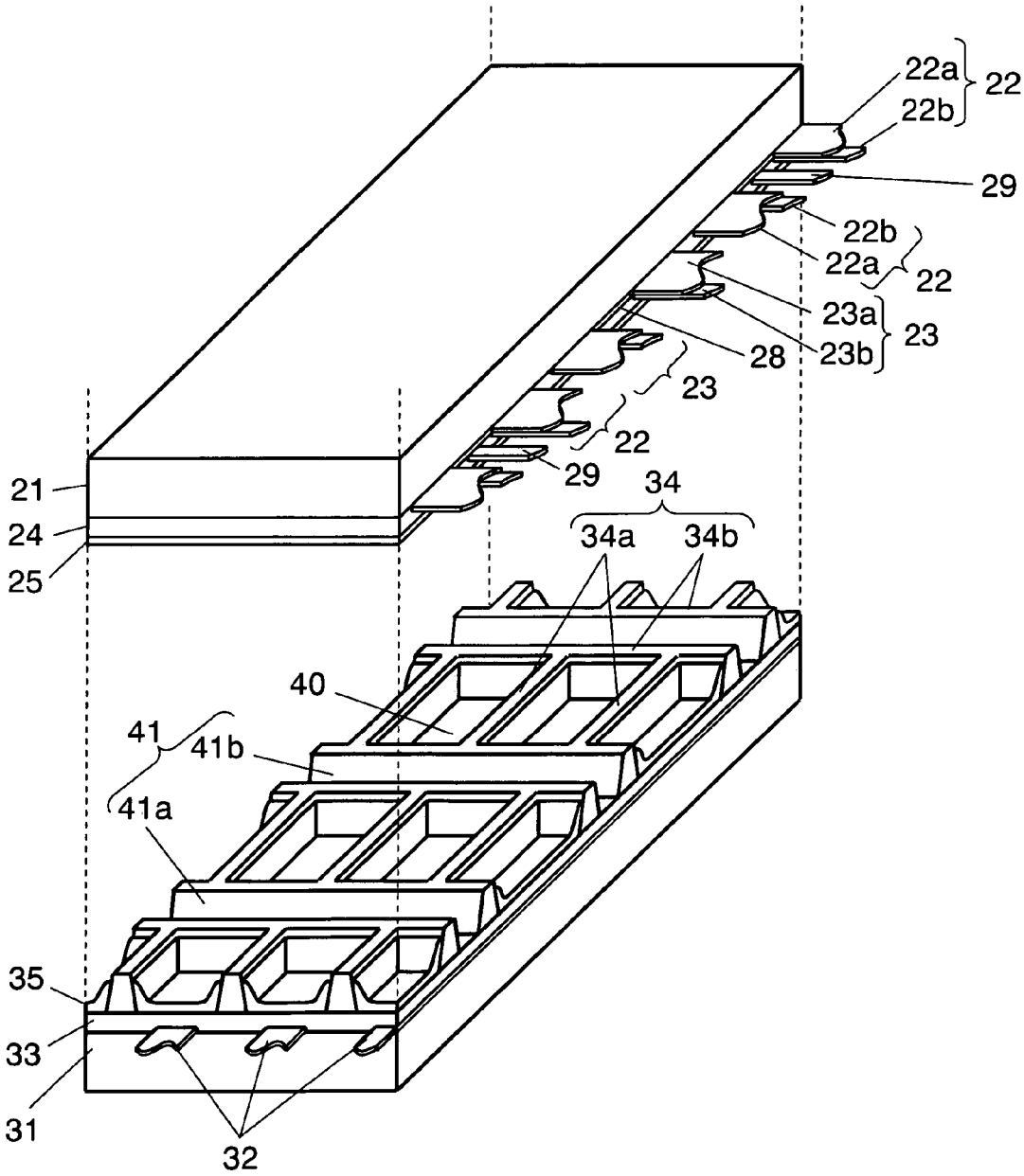
FIG. 1 shows a perspective exploded view illustrating a structure of a panel in accordance with an embodiment of the present invention.

10 panel
21 front substrate
22 scan electrode
22*a*, 23*a* transparent electrode
22*b*, 23*a* metallic bus line
23 sustain electrode
24 dielectric layer
25 protective layer
28 light absorption layer
29 priming layer
31 rear substrate
32 data electrode
33 dielectric layer
34 barrier rib
34*a* vertical wall
34*b* lateral wall
35 phosphor layer
40 primary discharge cell
41, 41*b* space
41*a* priming discharge cell
100 display device
101 video signal processing circuit
102 data electrode driving circuit
103 timing control circuit
104 scan electrode driving circuit
105 sustain electrode driving circuit
106 priming electrode driving circuit

DESCRIPTION OF PREFERRED EMBODIMENT

Exemplary Embodiment

Figure 2:
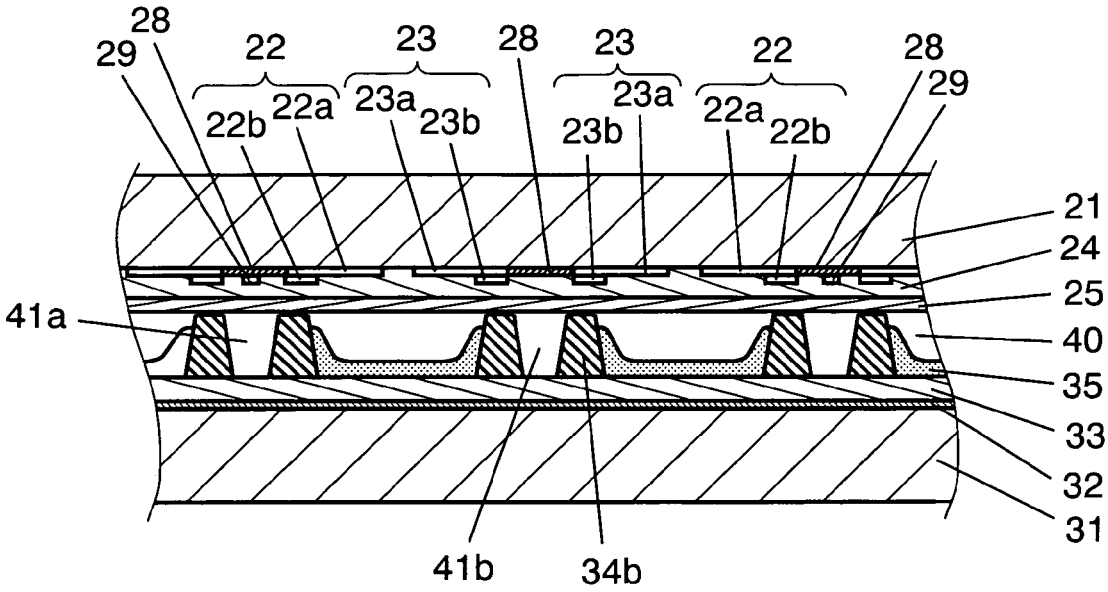
FIG. 2 shows a sectional view illustrating the panel shown in FIG. 1.

FIG. 1 shows a perspective exploded view illustrating a structure of a panel in accordance with this embodiment of the present invention. FIG. 2 shows a sectional view illustrating the same panel. A first substrate, i.e. front substrate 21 made of glass, confronts a second substrate, i.e. rear substrate 31, with a discharge space in between. The discharge space is filled with mixed gas of neon and xenon for radiating ultraviolet ray by discharging.

A plurality of display electrode pairs, each one of which pair is formed of scan electrode 22 and sustain electrode 23, are formed on front substrate 21 such that scan electrodes 22 and sustain electrodes 23 are placed in parallel with each other. For instance, a display electrode pair, formed of scan electrode 22 first and sustain electrode 23 second in this order, is adjacent to another display electrode pair formed of sustain electrode 23 first and scan electrode 22 second in this order. There are spaces between the display electrode pairs, and specifically between scan electrodes 22 confronting each other, priming electrode 29 is placed in parallel with the display electrode pair. Viewing from front substrate 21, electrodes are arranged on substrate 21 in this way: sustain electrode 23—scan electrode 22—priming electrode 29—scan electrode 22—sustain electrode 23—scan electrode 22—priming electrode 29—scan electrode 22—sustain electrode 23—, , , . Scan electrode 22 and sustain electrode 23 are respectively formed of transparent electrodes 22*a*, 23*a* and metallic bus lines 22*b*, 23*b* formed on the transparent electrodes 22*a*, 23*a*. In respective spaces between each two scan electrodes 22, between each two sustain electrodes 23, light absorption layer 28 made from material in black-color are formed on front substrate 21. Priming electrode 29 is formed on light absorption layer 28 formed on front substrate 21 and between each two scan electrodes 22 by using the metallic bus line. Dielectric layer 24 and protective layer 25 are formed to cover scan electrodes 22, sustain electrodes 23, priming electrodes 29 and light absorption layer 28.

On rear substrate 31, a plurality of data electrodes 32 are formed in parallel with each other in a direction crossing scan electrodes 22, and data electrodes 32 are covered with dielectric layer 33, on which barrier ribs 34 are formed for partitioning primary discharge cells 40.

Barrier ribs 34 are formed of vertical wall 34*a* extending along data electrodes 32 and lateral wall 34*b*. Those two walls define primary discharge cells 40, and yet lateral walls 34*b* define space 41 between primary discharge cells 40. Barrier ribs 34 thus form lines of primary discharge cells formed by linking a plurality of primary discharge cells 40 along the display electrode pair formed of scan electrode 22 and sustain electrode 23, and produce spaces 41 between the adjacent lines of the primary discharge cells. Priming electrode 29 is formed on front substrate 21 at space 41 placed on the side of two scan electrodes 22 adjacent to each other, and this space 41 works as priming discharge cell 41*a*. In other words, spaces 41 work as priming discharge cells 41*a* having priming electrodes 29 alternately. Meanwhile, spaces 41*b* are placed on the side of two sustain electrodes adjacent to each other.

Each one of tops of barrier ribs 34 are flash with each other and brought into contact with front substrate 21 such that ribs 34 underpin substrate 21. This structure allows preventing interference between primary discharge cells 40 adjacent to each other, in particular, preventing malfunction such as an error in addressing caused by the priming generated by address discharge of primary discharge cells 40 adjacent to each other. This structure also allows preventing malfunction such as failure in addressing to primary discharge cells 40 due to reduction in wall electric charges of primary discharge cell 40 adjacent to priming discharge cell 41*a*. This reduction in wall electric charges accompanies the priming discharge.

Phosphor layer 35 is provided to the lateral face of barrier ribs 34 and the surface of dielectric layer 33 corresponding to primary discharge cells 40 defined by barrier ribs 34. Although FIG. 1 does not show phosphor layer 35 on the space 41 side, it can be formed on the space 41 side. In the foregoing description, dielectric layer 33 covers data electrodes 32; however, dielectric layer 33 is not necessarily formed.

Figure 3:
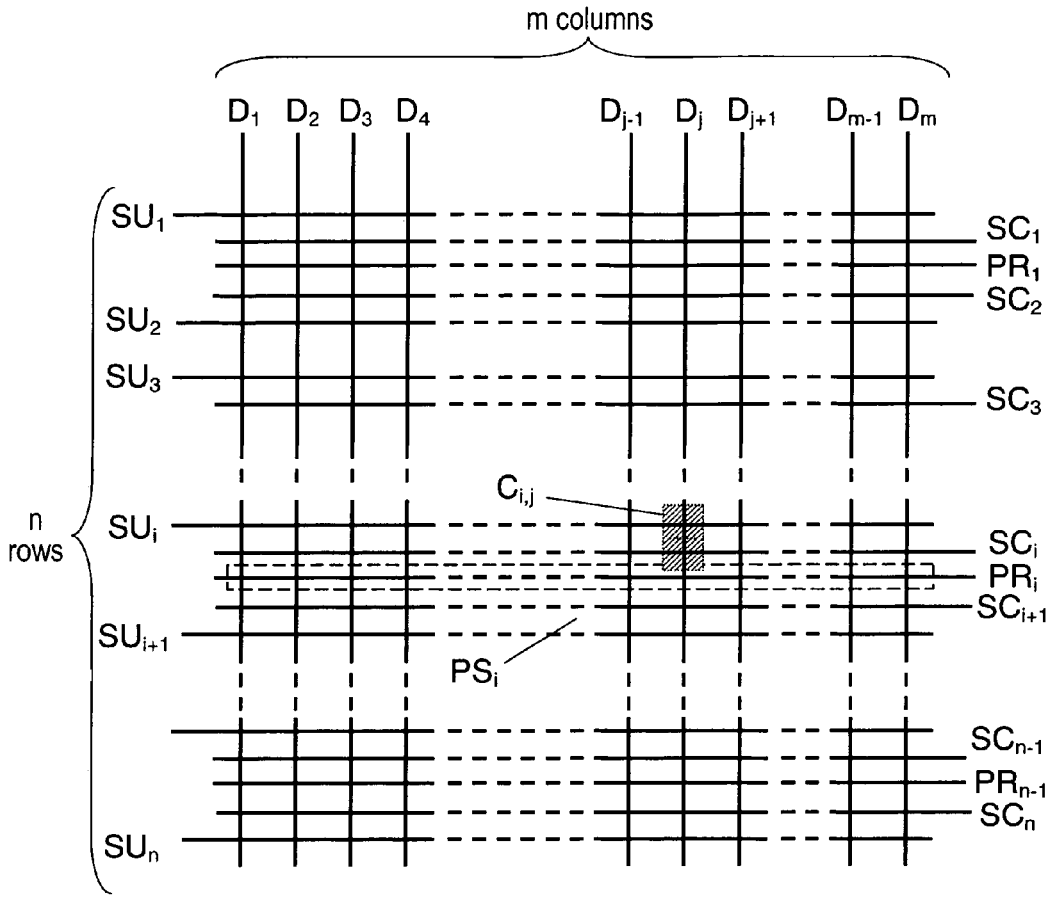
FIG. 3 illustrates an electrode-arrangement of the panel shown in FIG. 1.

FIG. 3 illustrates an electrode-arrangement of the panel in accordance with this embodiment. In the vertical direction, data electrodes $D_1$-$D_m$ for "m" columns are arranged in the vertical direction. In the horizontal direction, scan electrodes $SC_1$-$SC_n$ (scan electrodes 22 shown in FIG. 1) for "n" lines, sustain electrodes $SU_1$-$SU_n$ (sustain electrodes 23 shown in FIG. 1) for "n" lines, and priming electrodes $PR_1$-$PR_{n-1}$ (priming electrodes 29 shown in FIG. 1) for "n/2" lines are arranged in the following order: sustain electrode $SU_1$—scan electrode $SC_1$—priming electrode $PR_1$—scan electrode $SC_2$—sustain electrode $SU_2$—sustain electrode $SU_3$—scan electrode $SC_3$—priming electrode $PR_3$—scan electrode $SC_4$—sustain electrode $SU_4$—, , , . Primary discharge cell $C_{i,j}$ (primary discharge cell 40 shown in FIG. 1) comprising a pair of scan electrode $SC_i$, sustain electrode $SU_i$ (i=1–n) and one data electrode $D_j$ (j=1–m) is formed in a discharge space, the number of primary discharge cells $C_{i,j}$ counts "m×n" pieces. Priming discharge cells $PS_p$ (priming discharge cells 41*a* shown in FIG. 1) comprising priming electrodes $PR_p$ ("p" is an odd number) and data electrodes $D_1$-$D_m$ are formed in the discharge space, and the number of cells $RS_p$ counts n/2 pieces. Although this will be detailed later, the priming generated in this priming discharge cells $PS_p$ during the addressing period is supplied to primary discharge cells $C_{p,1}$-$C_{p,m}$, $C_{p+1,1}$-$C_{p+1,m}$ adjacent to priming discharge cell $PS_p$.

Figure 4:
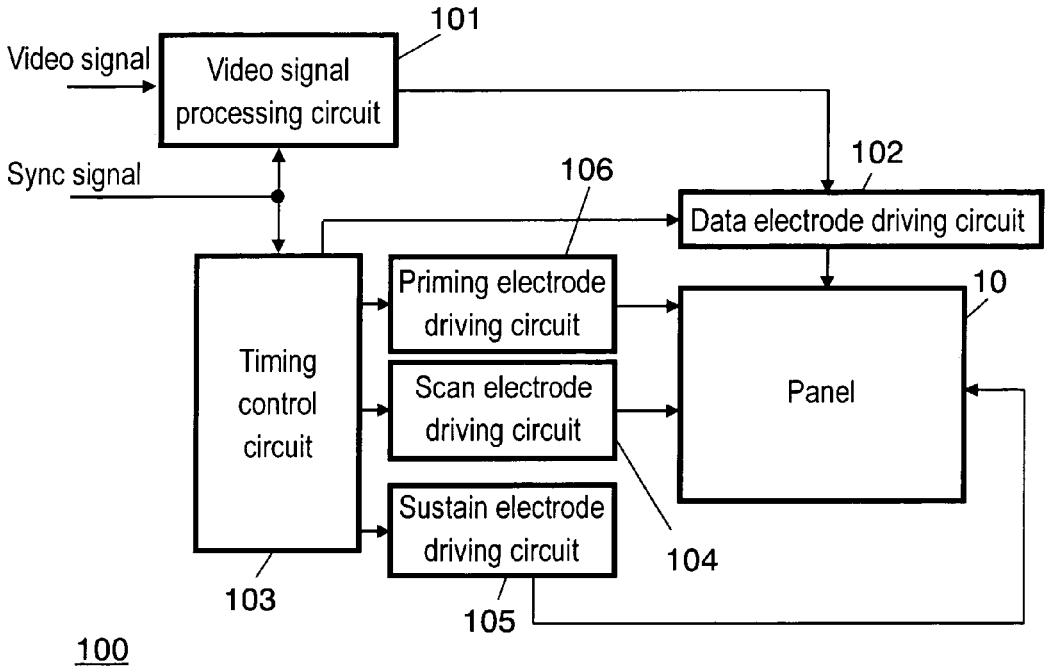
FIG. 4 shows a block diagram illustrating a circuit structure of a plasma display device employing the panel shown in FIG. 1.

FIG. 4 shows a block diagram illustrating a circuit structure of a plasma display device employing the panel in accordance with this embodiment of the present invention. Display device 100 comprises video signal processing circuit 101, data electrode driving circuit 102, timing control circuit 103, scan electrode driving circuit 104, sustain electrode driving circuit 105, and priming electrode driving circuit 106. A video signal and a sync signal are fed into video signal processing circuit 101, which supplies a sub-field signal to data electrode driving circuit 102 for controlling whether or not respective sub-fields are turned on based on the video signal and the sync signal. The sync signal is fed also to timing control circuit 103, which supplies timing control signals based on the sync signal to data electrode driving circuit 102, scan electrode driving circuit 104, sustain electrode driving circuit 105 and priming electrode driving circuit 106 respectively.

Data electrode driving circuit 102 applies a given driving waveform voltage to data electrodes 32 (data electrodes $D_1$-$D_m$ shown in FIG. 3) of panel 10 in response to the sub-field signals and the timing control signals. In response to the timing control signal, scan electrode driving circuit 104 applies a given driving waveform voltage to scan electrodes 22 (scan electrodes $SC_1$-$SC_n$ shown in FIG. 3) of panel 10. Sustain electrode driving circuit 105 applies a given driving waveform voltage to sustain electrodes 23 (sustain electrodes $SU_1$-$SU_n$ shown in FIG. 3) of panel 10 in response to the timing control signal. Priming electrode driving circuit 106 applies a given driving waveform voltage to priming electrodes 29 (priming electrodes $PR_1$-$PR_{n-1}$ shown in FIG. 3) of panel 10 in response to the timing control signal. A power supply circuit (not shown) supplies necessary power to data electrode driving circuit 102, scan electrode driving circuit 104, sustain electrode driving circuit 105, and priming electrode driving circuit 106 respectively.

Figure 5:
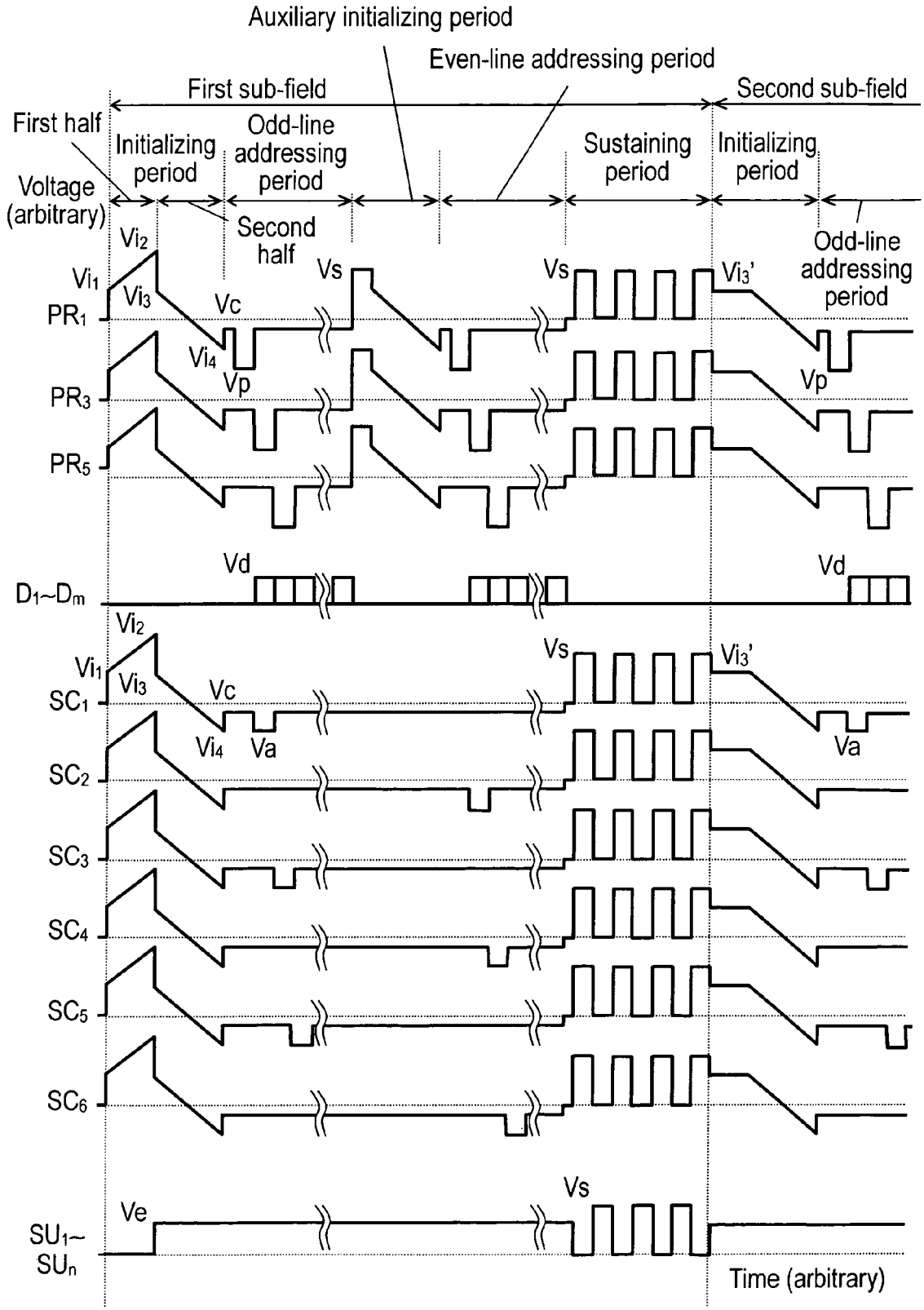
FIG. 5 shows driving waveforms of the panel shown in FIG. 1.

Next, a driving waveform necessary for driving the panel and its timing are described together with an operation of the panel. FIG. 5 shows driving waveforms of the panel in accordance with this embodiment. In this embodiment, one field is formed of plurality of sub-fields each one of which includes an initializing period, an addressing period, and a sustaining period. The addressing period includes an odd-line addressing period, in which primary discharge cells having odd-number scanning electrodes (hereinafter referred to simply as an odd-scan electrode) are addressed, and an even-line addressing period, in which primary discharge cells having even-number scanning electrodes (hereinafter referred to simply as an even-scan electrode) are addressed. Addressing by the odd-scan electrodes and that by the even-scan electrodes are conducted separately time-wise. The priming discharge cells are initialized before the odd-line addressing period and the even-line addressing period respectively. In this embodiment, assume that during the initializing period of the first sub-field, every cell is initialized, and for the second sub-field and onward, selected cells are initialized. Initializing every cell indicates that initializing discharge is generated in every primary discharge cell related to video-display, and initializing the selected cells indicates that initializing discharge is generated in the primary discharge cells which have conducted a sustain discharge during the sustaining period of the sub-field immediately before. The initializing period of every cell is divided into a first half and a second half for the description purpose.

During the first half initializing period of the first sub-field, data electrodes $D_1$-$D_m$ and sustain electrodes $SU_1$-$SU_n$ are maintained at 0 (zero) volt respectively. An inclined waveform voltage moderately increasing from voltage $Vi_1$ toward voltage $Vi_2$ is applied to scan electrodes $SC_1$-$SC_n$, where voltage $Vi_2$ is the voltage exceeding a breakdown voltage for sustain electrodes $SU_1$-$SU_n$ and data electrodes $D_1$-$D_m$. An inclined waveform voltage similar to that applied to scan electrodes $SC_1$-$SC_n$ is applied to priming electrodes $PR_1$-$PR_{n-1}$, then a faint initializing discharge occurs in primary discharge cells $C_{i,j}$, more specifically, between scan electrodes $SC_1$-$SC_n$ and sustain electrodes $SU_1$-$SU_n$ and between scan electrodes $SC_1$-$SC_n$ and data electrodes $D_1$-$D_m$. In the priming discharge cells, a faint initializing discharge occurs between respective priming electrodes $PR_1$-$PR_{n-1}$ and respective data electrodes $D_1$-$D_m$. Negative wall voltages are stored at the upper sections of scan electrodes $SC_1$-$SC_n$ and priming electrodes $PR_1$-$PR_{n-1}$ as well as positive wall voltages are stored at the upper sections of data electrodes $D_1$-$D_m$ and sustain electrodes $SU_1$-$SU_n$. The wall voltage stored at the upper sections of the electrodes represents a voltage produced by wall electric charges stored on the dielectric layer or the phosphor layer covering the electrodes.

During the second half of the initializing period, sustain electrodes $SU_1$-$SU_n$ are kept at positive voltage Ve, and an inclined waveform voltage moderately decreasing from voltage $Vi_3$ toward voltage $Vi_4$ is applied to scan electrodes $SC_1$-$SC_n$, where voltage $Vi_3$ falls below the breakdown voltage for data electrodes $D_1$-$D_m$. Voltage $Vi_4$ exceeds the breakdown voltage for sustain electrodes $SU_1$-$SU_n$ and data electrodes $D_1$-$D_m$. An inclined waveform voltage similar to that applied to scan electrodes $SC_1$-$SC_n$ is applied to priming electrodes $PR_1$-$PR_{n-1}$, then a faint initializing discharge occurs between scan electrodes $SC_1$-$SC_n$ and sustain electrodes $SU_1$-$SU_n$ and between scan electrodes $SC_1$-$SC_n$ and data electrodes $D_1$-$D_m$, and also between respective priming electrodes $PR_1$-$PR_{n-1}$ and respective data electrodes $D_1$-$D_m$. Those faint initializing discharges allow weakening the negative wall voltage stored at the upper sections of scan electrodes $SC_1$-$SC_n$ and the positive wall voltages stored at the upper sections of sustain electrodes $SU_1$-$SU_n$, and also adjusting the positive wall voltages stored at the upper sections of data electrodes $D_1$-$D_m$ to values appropriate to an address operation. On top of that, the wall voltage stored at the upper section of priming electrodes $PR_1$-$PR_{n-1}$ are also adjusted to values appropriate to the priming operation. The foregoing mechanism tells all about the initializing of every cell, i.e. every discharge cell related to video display is discharged for initialization.

During the odd-line addressing period, scan electrodes $SC_1$-$SC_n$ and priming electrodes $PR_1$-$PR_{n-1}$ are kept temporarily at voltage Vc in order to avoid generating unnecessary discharge when address pulse voltage Vd is applied, which is detailed later. Then negative priming pulse voltage Vp is applied to priming electrode $PR_1$ on the first line. This priming pulse voltage has a so large amplitude that priming discharge occurs between priming electrode $PR_1$ and data electrodes $D_1$-$D_m$ regardless of the presence of address pulse voltages to be applied to data electrodes $D_1$-$D_m$. Then the priming is supplied into primary discharge cells $C_{1,1}$-$C_{1,m}$ on the first line. This discharge allows storing positive wall voltages at the upper section of priming electrode $PR_1$.

Next, negative scan pulse voltage Va is applied to scan electrode $SC_1$ on the first line while positive address pulse voltage Vd is applied to data electrode $D_k$ ("k" is an integer among 1–m), corresponding to the video signals to be displayed on the first line, out of data electrodes $D_1$-$D_m$. Then a discharge occurs at the intersection of scan electrode $SC_1$ and data electrode $D_k$ to which address pulse voltage Vd is applied, and this discharge develops into a discharge between sustain electrode $SU_1$ and scan electrode $SC_1$ of corresponding primary discharge cell $C_{1,k}$, which then stores a positive wall voltage at the upper section of scan electrode $SC_1$, and a negative wall voltage at the upper section of sustain electrode $SU_1$. The address operation to the first line is thus completed. The address discharge in primary discharge cell $C_{1,k}$ occurs immediately after the priming discharge, which is generated between priming electrode $PR_1$ and data electrodes $D_1$-$D_m$, supplies the priming to the primary discharge cell, so that a steady discharge with a smaller discharge delay can be expected.

Scan pulse voltage Va is applied to scan electrode $SC_1$ on the first line while priming pulse voltage Vp is applied to priming electrode $PR_3$, then a priming discharge occurs between priming electrode $PR_3$ and data electrodes $D_1$-$D_m$ regardless of the presence of address pulse voltages to be applied to data electrodes $D_1$-$D_m$. Then the priming is supplied into primary discharge cells $C_{3,1}$-$C_{3,m}$ on the third line. This discharge allows storing positive wall voltages at the upper section of priming electrode $PR_3$.

Next, negative scan pulse voltage Va is applied to scan electrode $SC_3$ on the third line while positive address pulse voltage Vd is applied to data electrode $D_k$, corresponding to the video signals to be displayed on the third line, out of data electrodes $D_1$-$D_m$. Then a discharge occurs at the intersection of scan electrode $SC_3$ and data electrode $D_k$ to which address pulse voltage Vd is applied, and this discharge develops into a discharge between sustain electrode $SU_3$ and scan electrode $SC_3$ of corresponding primary discharge cell $C_{3,k}$, which then stores a positive wall voltage at the upper section of scan electrode $SC_3$, and a negative wall voltage at the upper section of sustain electrode $SU_3$. The address operation to the third line is thus completed. The address discharge in primary discharge cell $C_{3,k}$ occurs immediately after the priming discharge, which is generated between priming electrode $PR_3$ and data electrodes $D_1$-$D_m$, supplies the priming to the primary discharge cell, so that a steady discharge with a smaller discharge delay can be expected.

Scan pulse voltage Va is applied to scan electrode $SC_3$ on the third line while priming pulse voltage Vp is applied to priming electrode $PR_5$ for generating the priming discharge. Then priming is supplied into primary discharge cells $C_{5,1}$-$C_{5,m}$ on the fifth line.

Address operations similar to the foregoing ones are conducted down to the last odd-number primary discharge cell $C_{n-1,k}$ before the entire address operation is completed. The address discharges in respective primary discharge cells $C_{i,j}$ occur immediately after the adjacent priming discharge cell supplies the priming to the primary discharge cell, so that a steady discharge with a smaller discharge delay can be expected.

Next, the priming discharge cell is initialized again. Hereinafter this period is referred to as an auxiliary initializing period, in which sustain electrodes $SU_1$-$SU_n$ are kept at voltage Ve and scan electrodes $SC_1$-$SC_n$ are kept at voltage Vc while voltage Vs is applied to priming electrodes $PR_1$-$PR_{n-1}$. Then discharge occurs between respective priming electrodes $PR_1$-$PR_{n-1}$ and respective data electrodes $D_1$-$D_m$, so that negative wall voltages are stored at the upper sections of priming electrodes $PR_1$-$PR_{n-1}$ and positive wall voltages are stored at the upper sections of data electrodes $D_1$-$D_m$.

Next, an inclined waveform voltage similar to that of the second half of the initializing period is applied to the scan electrodes, then a faint initializing discharge occurs again between respective priming electrodes $PR_1$-$PR_{n-1}$ and respective data electrodes $D_1$-$D_m$. Those faint initializing discharges adjust the positive wall voltages stored at the upper sections of data electrodes $D_1$-$D_m$ to values appropriate to an address operation. The wall voltages stored at the upper section of priming electrodes $PR_1$-$PR_{n-1}$ are also adjusted to values appropriate to the priming operation.

In the even-line addressing period following the foregoing operations, priming electrodes $PR_1$-$PR_{n-1}$ are kept at voltage Vc temporarily, then negative priming pulse voltage Vp is applied to priming electrode $PR_1$. Priming discharge then occurs between priming electrode $PR_1$ and data electrodes $D_1$-$D_m$ regardless of the presence of address pulse voltages to be applied to data electrodes $D_1$-$D_m$. Then the priming is supplied into primary discharge cells $C_{2,1}$-$C_{2,m}$ on the second line. This discharge allows storing positive wall voltages at the upper section of priming electrode $PR_1$.

Next, negative scan pulse voltage Va is applied to scan electrode $SC_2$ on the second line while positive address pulse voltage Vd is applied to data electrode $D_k$, corresponding to the video signals to be displayed on the second line, out of data electrodes $D_1$-$D_m$. Then a discharge occurs at the intersection of scan electrode $SC_2$ and data electrode $D_k$ to which address pulse voltage Vd, and this discharge develops into a discharge between sustain electrode $SU_2$ and scan electrode $SC_2$ of corresponding primary discharge cell $C_2$, k, which then stores a positive wall voltage at the upper section of scan electrode $SC_2$, and a negative wall voltage at the upper section of sustain electrode $SU_2$. The address operation to the second line is thus completed. The address discharge in primary discharge cell $C_{2,k}$ occurs immediately after the priming discharge, which is generated between priming electrode $PR_1$ and data electrodes $D_1$-$D_m$, supplies the priming to the primary discharge cell, so that a steady discharge with a smaller discharge delay can be expected.

Scan pulse voltage Va is applied to scan electrode $SC_2$ on the second line while priming pulse voltage Vp is applied to priming electrode $PR_3$, then priming discharge occurs between priming electrode $PR_3$ and data electrodes $D_1$-$D_m$ regardless of the presence of address pulse voltages to be applied to data electrodes $D_1$-$D_m$. Then the priming is supplied into primary discharge cells $C_{4,1}$-$C_{4,m}$ on the fourth line. This discharge allows storing positive wall voltages at the upper section of priming electrode $PR_3$.

Next, scan pulse voltage Va is applied to scan electrode $SC_4$ on the fourth line while positive address pulse voltage Vd is applied to data electrode $D_k$, corresponding to the video signals to be displayed on the fourth line, out of data electrodes $D_1$-$D_m$. Then a discharge occurs at the intersection of scan electrode $SC_4$ and data electrode $D_k$ to which address pulse voltage Vd is applied, and this discharge develops into a discharge between sustain electrode $SU_4$ and scan electrode $SC_4$ of corresponding primary discharge cell $C_{4,k}$, which then stores a positive wall voltage at the upper section of scan electrode $SC_4$, and a negative wall voltage at the upper section of sustain electrode $SU_4$. The address operation to the fourth line is thus completed. The address discharge in primary discharge cell $C_{4,k}$ occurs immediately after the priming discharge, which is generated between priming electrode $PR_3$ and data electrodes $D_1$-$D_m$, supplies the priming to the primary discharge cell, so that a steady discharge, with a smaller discharge delay can be expected.

Scan pulse voltage Va is applied to scan electrode $SC_4$ on the fourth line while priming pulse voltage Vp is applied to priming electrode $PR_5$ on the fifth line. This priming pulse voltage Vp has a so large amplitude that a priming discharge occurs between priming electrode $PR_5$ and data electrodes $D_1$-$D_m$ regardless of the presence of address pulse voltages to be applied to data electrodes $D_1$-$D_m$. Then the priming is supplied into primary discharge cells $C_{5,1}$-$C_{5,m}$ on the fifth line.

Address operations similar to the foregoing ones are conducted down to the last even-number primary discharge cell $C_{n,k}$ before the entire address operation is completed. The address discharges in respective primary discharge cells $C_{i,j}$ occur immediately after the adjacent priming discharge cell supplies the priming to the primary discharge cell, so that a steady discharge with a smaller discharge delay can be expected.

During the sustaining period, scan electrodes $SC_1$-$SC_n$, priming electrodes $PR_1$-$PR_{n-1}$, and sustain electrodes $SU_1$-$SU_n$ are reset temporarily to 0 (zero) volt. Then positive sustain pulse voltage Vs is applied to scan electrodes $SC_1$-$SC_n$. At this time, not only sustain pulse voltage Vs but also the wall voltage stored at the upper section of scan electrode $SC_i$ and the upper section of sustain electrode $SU_i$ are added to a voltage across the upper section of scan electrode $SC_1$ and the upper section of sustain electrode $SU_1$ of primary discharge cell $C_{i,j}$ generating an address discharge. This voltage thus exceeds the breakdown voltage and generates sustain discharge. From this onward, the sustain pulse voltage is similarly applied to scan electrodes $SC_1$-$SC_n$ and sustain electrodes $SU_1$-$SU_n$ alternately, so that the sustain discharge successively repeats the number of sustain pulses in primary discharge cell $C_{i,j}$.

As shown in FIG. 5, a sustain pulse voltage similar to the one applied to scan electrodes $SC_1$-$SC_n$ is applied to priming electrodes $PR_1$-$PR_{n-1}$. Since positive wall voltages are stored at the upper sections of priming electrodes $PR_1$-$PR_{n-1}$ during the addressing period, a discharge occurs in the priming discharge cell when an initial sustain pulse voltage is applied; however, the discharge does not occur onward.

During the initializing period of a second sub-field succeeding, sustain electrodes $SU_1$-$SU_n$ are kept at positive voltage Ve, and an inclined waveform voltage moderately decreasing from voltage $Vi_3'$ toward voltage $Vi_4$ is applied to scan electrodes $SC_1$-$SC_n$ and priming electrodes $PR_1$-$PR_{n-1}$, then a faint initializing discharge occurs in primary discharge cells $C_{i,k}$, which has conducted the sustain discharge, more specifically, the faint initializing discharges occur between scan electrodes $SC_1$-$SC_n$ and sustain electrodes $SU_1$-$SU_n$ and between scan electrodes $SC_1$-$SC_n$ and data electrodes $D_1$-$D_m$, and between priming electrodes $PR_1$-$PR_{n-1}$ and data electrodes $D_1$-$D_m$. Those faint initializing discharges allow weakening the wall voltage stored at the upper sections of scan electrodes $SC_1$-$SC_n$ and the wall voltages stored at the upper sections of sustain electrodes $SU_1$-$SU_n$, and also adjusting the positive wall voltages stored at the upper sections of data electrodes $D_1$-$D_m$ to values appropriate to an address operation. On top of that, the wall voltage stored at the upper section of priming electrodes $PR_1$-$PR_{n-1}$ are also adjusted to values appropriate to the priming operation.

A mechanism similar to what is discussed above can be seen from this onward in the odd-line addressing period, auxiliary initializing period, even-line addressing period, sustaining period, driving waveform of a succeeding sub-field, and operation of the panel.

The address discharge of the primary discharge cell during the odd-line addressing period and the even-line addressing period occurs immediately after the priming discharge cells adjacent to respective primary discharge cells supply the priming to the primary discharge cells, so that a steady discharge with a smaller discharge delay can be expected. Discharges irrelevant to the video display occur in the priming discharge cells at the application of a first sustain pulse voltage in the odd-line addressing period, even-line addressing period and sustaining period. However, the priming discharge cell is provided with light absorption layer 28, so that light emission due to the discharges irrelevant to the video display will not leak outside the panel.

During the odd-line addressing period, scan pulse voltage Va applied to scan electrode $SC_1$ coincides with priming pulse voltage Vp applied to priming electrode $PR_3$. Scan pulse voltage Va applied to scan electrode $SC_3$ coincides with priming pulse voltage Vp applied to priming electrode $PR_5$. As such, a time span of applying a scan pulse voltage to scan electrode $SC_{p-2}$ overlaps time-wise a time span of applying a priming pulse voltage to priming electrode $PR_p$. On top of that, in the even-line addressing period, scan pulse voltage Va applied to scan electrode $SC_2$ coincides with priming pulse voltage Vp applied to priming electrode $PR_3$, and scan pulse voltage Va applied to scan electrode $SC_4$ coincides with priming pulse voltage Vp applied to priming electrode $PR_5$. As such, a time span of applying a scan pulse voltage to scan electrode $SC_{p-1}$ overlaps time-wise a time span of applying a priming pulse voltage to priming electrode $PR_p$. There is thus no need to newly reserve a time for the priming discharge except the priming discharge for the first line. In this embodiment, during the odd-line addressing period, an address discharge is generated between scan electrode $SC_{p-2}$ and data electrode $D_k$ while a priming discharge is generated between priming electrodes $PR_p$ and data electrodes $D_1$-$D_m$. During the even-line addressing period, an address discharge is generated between scan electrode $SC_{p-1}$ and data electrode $D_k$ while a priming discharge is generated between priming electrodes $PR_p$ and data electrodes $D_1$-$D_m$. Those discharges allow generating the priming discharge without prolonging the driving time of the panel, and the sustaining period is not shortened, which can avoid lowering the brightness. Further, a driving margin of an address operation is not narrowed, and the address discharge can be generated in a stable manner advantageously.

In the foregoing description of the operation, every primary discharge cell is initialized for a next addressing during the initializing period of the first sub-field, then primary discharge cells that have conducted sustain discharge are selectively initialized during the initializing periods of the second sub-field and onward. However, those initializing operations can be combined arbitrarily.

Figure 6:
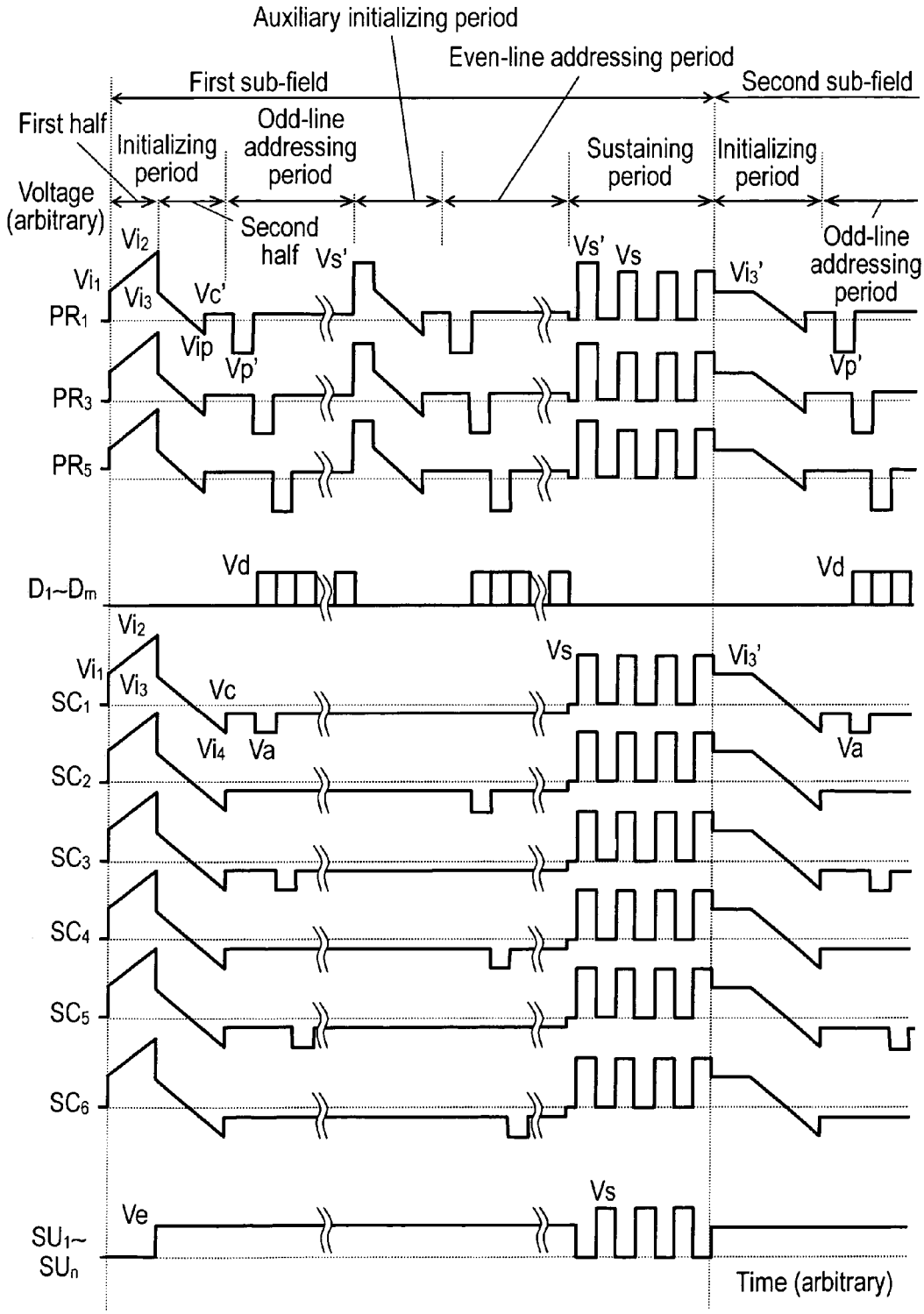
FIG. 6 shows driving waveforms of a panel in accordance with another embodiment of the present invention.

The driving waveform-voltages to be applied to the respective electrodes are preferably determined in response to the characteristics and the driving conditions of the panel. FIG. 6 shows driving waveform voltages of a panel in accordance with another embodiment of the present invention. The driving waveform shown in FIG. 6 features a sustain pulse voltage Vs' firstly applied to the priming electrode is greater than other voltages Vs applied onward, thereby stabilizing the operation of the priming discharge cell. Another feature is that the driving waveform to be applied to the priming electrode during the second half of the initializing period is devised such that priming pulse voltage Vp' can be set equal to scan pulse voltage Va.

To be more specific, an inclined waveform voltage similar to the one applied to scan electrodes $SC_1$-$SC_n$ is applied to priming electrodes $PR_1$-$PR_{n-1}$, however, in this case the voltage is not lowered to as low as $Vi_4$, but stopped lowering before it reaches $Vi_p$ as shown in FIG. 6. Then priming electrodes $PR_1$-$PR_{n-1}$ are temporarily kept at voltage Vc' which is set approximately equal to a voltage of "$Vi_p$+address pulse voltage Vd" in order to prevent an unnecessary discharge from accompanying the application of address pulse voltage Vd. Negative priming pulse voltage Vp' approximately equal to scan pulse voltage Va is applied to priming electrode $PR_1$. At this time, a priming discharge occurs because a large amount of wall voltages formed during the initializing period remain at the upper sections of priming electrodes $PR_1$-$PR_{n-1}$, thereby supplying the priming to the adjacent prime discharge cell. Priming pulse voltage Vp' can be set equal to scan pulse voltage Va, so that the power supply can be shared with others. The circuit structure can be thus simplified.

During the sustaining period, a sustain pulse voltage similar to the one applied to scan electrodes $SC_1$-$SC_n$ is applied to priming electrodes $PR_1$-$PR_{n-1}$. At this time, sustain pulse voltage Vs' firstly applied is set greater than sustain pulse voltage Vs applied from this onward. A voltage to be applied to priming electrodes $PR_1$-$PR_{n-1}$ during the auxiliary initializing period are also set at voltage Vs' because of the following reason: During the addressing period, a priming discharge occurs between priming electrode $PR_p$ and data electrodes $D_1$-$D_m$, at this time, two kinds of data electrodes exist in $D_1$-$D_m$, i.e. data electrodes applied with address pulse voltage Vd and data electrodes without Vd. After the priming discharge, the wall voltage stored at the upper sections of data electrodes without Vd are possibly smaller than that of data electrodes applied with address pulse voltage Vd. Even if the wall voltage is smaller, the discharge must occur without fail. For this purpose, the sustain pulse voltage firstly applied is set greater than the ones to be applied onward.

As discussed above, the present invention provides a plasma driving method that can steadily generate address discharges without narrowing a margin in a driving voltage of an address operation.

INDUSTRIAL APPLICABILITY

The present invention allows generating address discharges steadily without narrowing a margin in a driving voltage of an address operation. This method is useful as a method of driving a panel used in wall-mounted television receivers or large-size monitors.

The invention claimed is:

1. A method of driving a plasma display panel, the panel comprising:

a plurality of display electrode pairs each one of the display electrode pairs including a scan electrode and a sustain electrode disposed on a first substrate;

a plurality of priming electrodes disposed in parallel with and between every other display electrode pairs disposed on the first substrate; and a plurality of data electrodes disposed on a second substrate, confronting the first substrate with a discharge space therebetween, such that the data electrodes are placed in a direction crossing the display electrode pairs, wherein the display electrode pairs confront the data electrodes for forming primary discharge cells, and the priming electrodes confront the data electrodes for forming priming discharge cells, wherein one field comprises a plurality of sub-fields each one of the sub-fields including an initializing period, an addressing period, and a sustaining period, wherein the addressing period includes an odd-line addressing period in which an address operation is conducted to primary discharge cells having odd-number scan electrodes, an even-line addressing period in which an address operation is conducted to primary discharge cells having even-number scan electrodes, wherein during the odd-line addressing period, a scan pulse voltage is applied to odd-number scan electrodes sequentially while a priming pulse voltage is applied, prior to the application of the scan pulse voltage, to a priming electrode adjacent to the scan electrode to which the scan pulse voltage is to be applied, in order to generate a priming discharge between the priming electrodes and the data electrodes, and wherein during the even-line addressing period, a scan pulse voltage is applied to even-number scan electrodes sequentially while a priming pulse voltage is applied, prior to the application of the scan pulse voltage, to a priming electrode adjacent to the scan electrode to which the scan pulse voltage is to be applied, in order to generate a priming discharge between the priming electrodes and the data electrodes.

2. The method of claim 1, wherein during the addressing period, a time span of applying the scan pulse voltage to the scan electrodes overlaps a time span of applying the priming pulse voltage to the priming electrode.

3. The method of claim 1, wherein an auxiliary initializing period is provided between the odd-line addressing period and the even-line addressing period for conducting an initializing discharge between the priming electrode and the data electrode.

* * * * *